US008362715B2

(12) United States Patent
Snijder et al.

(10) Patent No.: US 8,362,715 B2
(45) Date of Patent: Jan. 29, 2013

(54) LIGHTING SYSTEM COMPRISING INTERCONNECTABLE LIGHTING MODULES

(75) Inventors: Pieter Jacobus Snijder, Eindhoven (NL); Martin Gerard Hendrik Hiddink, Eindhoven (NL); Pieter Hubertus Franciscus Deurenberg, Eindhoven (NL); Johannes Martinus Maria Welschen, Eindhoven (NL); Victor J. Zwanenberg, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 13/343,104

(22) Filed: Jan. 4, 2012

(65) Prior Publication Data

US 2012/0104976 A1 May 3, 2012

Related U.S. Application Data

(63) Continuation of application No. 12/097,283, filed on Jun. 13, 2008, now Pat. No. 8,111,022.

(30) Foreign Application Priority Data

Dec. 16, 2005 (EP) ..... 05112322

(51) Int. Cl.
*H05B 37/00* (2006.01)

(52) U.S. Cl. ..... 315/312; 315/324; 362/225; 362/457; 361/824

(58) Field of Classification Search ..... 362/121, 362/125, 145, 151, 152, 219, 225, 368, 382, 362/457; 315/200 R, 312, 324, 363
See application file for complete search history.

(56) References Cited

U.S. PATENT DOCUMENTS

| | | | | |
|---|---|---|---|---|
| 4,413,311 | A * | 11/1983 | Orenstein | 362/219 |
| 4,532,579 | A * | 7/1985 | Merryman | 362/239 |
| 5,628,557 | A * | 5/1997 | Huang | 362/249.14 |
| 7,290,922 | B2 * | 11/2007 | Scalfi | 362/647 |
| 7,380,961 | B2 * | 6/2008 | Moriyama et al. | 362/238 |
| 2001/0024368 | A1 | 9/2001 | Henrici et al. | |
| 2005/0007780 | A1 | 1/2005 | Feuerborn et al. | |
| 2005/0116667 | A1 | 6/2005 | Mueller et al. | |
| 2005/0201087 | A1 | 9/2005 | Ward | |

FOREIGN PATENT DOCUMENTS

| | | | |
|---|---|---|---|
| EP | 1519106 | A2 | 3/2005 |
| WO | 03071187 | A1 | 8/2003 |

OTHER PUBLICATIONS

Written Optinion; International Application No. PCT/IB2006/054604.

* cited by examiner

*Primary Examiner* — Jimmy Vu
(74) *Attorney, Agent, or Firm* — John F. Salazar; Mark L. Beloborodov

(57) ABSTRACT

This invention relates to a lighting system. The lighting system includes a plurality of interconnectable polygonal lighting modules, wherein each lighting module has a plurality of connection members each including at least one electrical terminal. The connection members are arranged rotationally symmetrically at the lighting module. The lighting system further includes bridge members. Each bridge member has bridge terminals and is mountable at neighboring connection members of different lighting modules, to form a bridge providing an electric connection between connection terminals of the different connection members.

14 Claims, 8 Drawing Sheets

LIGHTING SYSTEM COMPRISING INTERCONNECTABLE LIGHTING MODULES

This is a continuation of prior application Ser. No. 12/097,283 filed Jun. 13, 2008 and is incorporated by reference herein.

FIELD OF THE INVENTION

The present invention relates to a lighting system comprising a plurality of interconnectable polygonal lighting modules.

BACKGROUND OF THE INVENTION

Lighting systems of the kind referred to here generally consist of polygonal lighting modules, i.e. light emitting modules, which are arranged to form an arrangement of a desired shape and size. For example, walls are fully or partly covered with a lighting module arrangement for displaying large images, or three-dimensional structures are formed for aesthetic applications.

One lighting system is disclosed in published US patent application No. 2005/0116667 A1. In that prior art system the lighting modules are thin building blocks called tiles, and the lighting modules are provided with electrical and mechanical connection means for interconnecting the lighting modules. These connection means are provided at the sides of the lighting modules.

However, US 2005/0116667 does not disclose any solution of how to actually design the lighting modules in order to obtain the interconnections. The electrical connections are used for powering electronic circuitry of the lighting modules. It is desirable that the lighting modules can be freely assembled to a large unit, or arrangement, without having to consider orientation of each lighting module. In other words, it is desirable that arbitrary sides of different lighting modules can be face each other.

SUMMARY OF THE INVENTION

It is an object of the present invention to provide a lighting system that has lighting modules, which are arbitrarily connectable as regards the rotation thereof.

This object is achieved by a lighting system according to the present invention as defined in claim 1.

Thus, in accordance with an aspect of the present invention, there is provided a lighting system comprising a plurality of interconnectable polygonal lighting modules, wherein each lighting module has a plurality of connection members, each comprising at least one electrical terminal, which are arranged rotationally symmetrically at the lighting module. The lighting system further comprises bridge members, wherein each bridge member comprises bridge terminals and is mountable at neighboring connection members, each associated with a respective lighting module, to form a bridge providing an electric connection between connection terminals of the connection members.

By providing a connection member structure that is rotationally symmetrical, and by using separate bridge members a degree of interconnectability freedom is introduced, which is useful for enabling the a simple connection of lighting modules at an arbitrary rotation. In accordance with an embodiment of the lighting system as defined in claim 2, both DC power and AC power can be used for energizing the lighting modules.

In accordance with an embodiment of the lighting system as defined in claim 3, a corner connection power system is provided. The connection members arranged at the corners, i.e. at four corners of a square module or at six corners of a hexagonal module, of the polygonal lighting module can be the only connection members, or they can be combined with side connection members as well, or only side connection members can be used, as defined in claim 4.

In accordance with an embodiment of the lighting system as defined in claim 5, a side bridge member contains at least two terminals. The minimum of two terminals is useful for a combination of corner and side connection members, where, for each side of the lighting module, one power connection, such as a neutral connection for AC or a minus connection for DC, is connected to the corner terminals and the other, i.e. the line connection or the plus connection, is connected to the side terminal. Further options will be explained below.

In accordance with embodiments of the lighting system as defined in claims 7-8, only side connection members are provided. Then, preferably, there are at least four bridge terminals for connecting at least two connection terminals of each connection member with corresponding terminals of the neighboring connection member.

In accordance with an embodiment of the lighting system as defined in claim 10, a flexible bridge member for use with DC power connections is provided.

In accordance with an embodiment of the lighting system as defined in claim 12, irrespective of the rotation of the lighting modules two connection terminals facing each other and belonging to different, neighboring connection members are always associated with different polarities. I conjunction with the just mentioned bridge member a totally failsafe mounting is achieved.

In accordance with an embodiment of the lighting system as defined in claim 13, also a mechanical connection is obtained by means of the bridge member. Thereby, a lighting module arrangement can be assembled without any further mechanical connectors.

In accordance with an embodiment of the lighting system as defined in claim 14, a combined mechanical and electrical connection is obtained. The same applies to the embodiment defined in claim 15.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1:
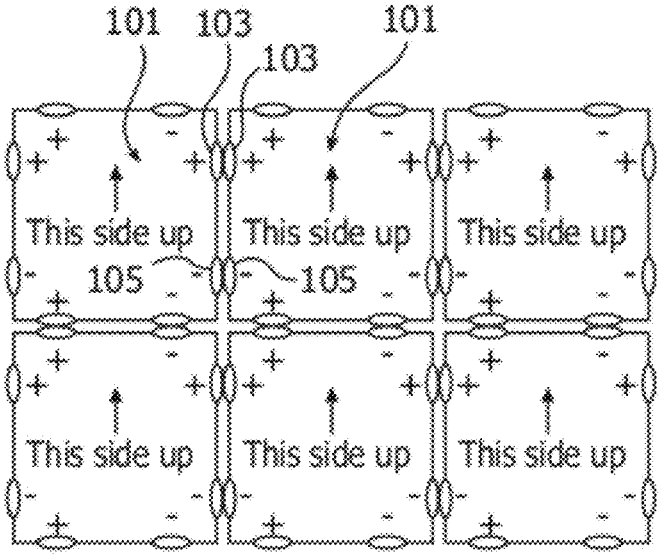
FIG. 1 illustrates a configuration of lighting modules, which have to be rotationally aligned with each other.

When building a lighting system a plurality of lighting modules are assembled to an arrangement of desired size and shape. In order not to have to power each lighting module individually by separate wiring the lighting modules are designed to be interconnectable. A straightforward solution to the problem of electrically interconnecting lighting modules 101 is shown in FIG. 1. At each side of the lighting module there are provided one positive terminal 103 and one negative terminal 105. All positive terminals are interconnected inside the lighting module 101, and so are all the negative terminals 105. Terminals of the same polarity, such as positive terminals 103 or negative terminals 105, located on neighboring lighting modules 101 are positioned side by side when the lighting modules 101 are assembled to a lighting module arrangement of desired shape and size. Then it is easy to make electrical connections between the terminals 103 or 105 of the same polarity located on neighboring lighting modules. However, this solution introduces restrictions on the orientation of the lighting modules 101. In a sense they have to be marked "this side up" in order not to be erroneously mounted. If turned 90 degrees wrongly, a positive and a negative terminal would be interconnected, which would of course cause a short-circuit.

Figure 2:
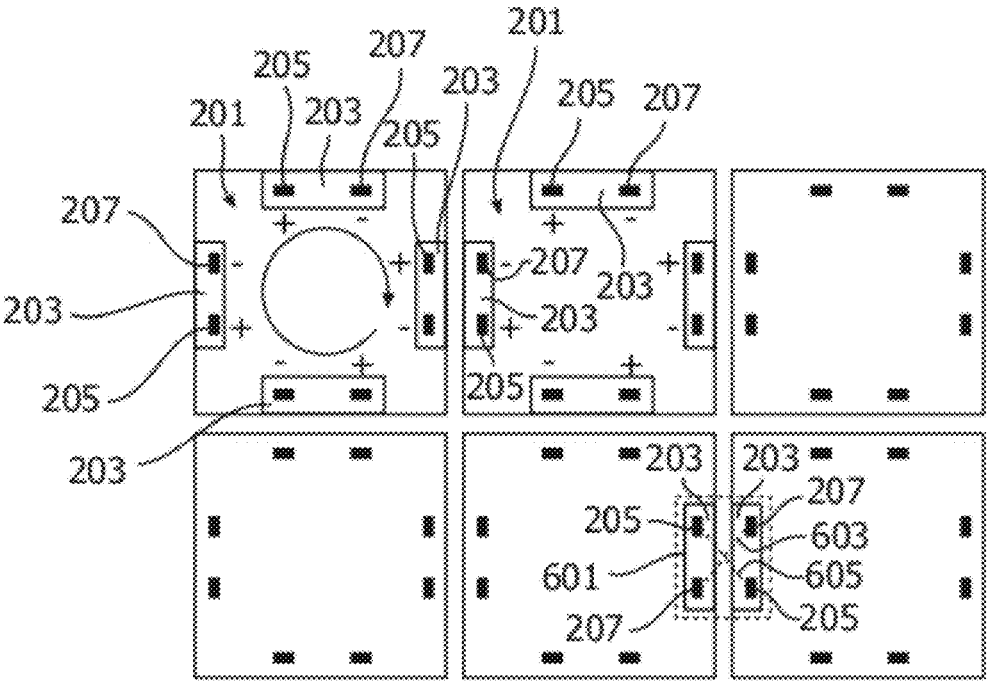
FIG. 2 illustrates a configuration of lighting modules, which are mountable with an arbitrary rotation according to an embodiment of the lighting system of this invention.

In accordance with a first embodiment of the present invention the polygonal, here square, lighting modules 201, as shown in FIG. 2, of the lighting system are designed as follows. Each lighting module 201 is provided with a DC connection member 203 at each side thereof. Internally of the lighting module 201 the DC connection members 203 are connected in parallel to internal circuitry. Each DC connection member 203 comprises connection terminals including a positive terminal 205 and a negative terminal 207. All positive terminals 205 of the lighting module 201 are connected with each other, and so are all negative terminals 207 as well. The connection members 203 of each lighting module 201 are equally directed, and the connection terminals 205, 207 are alternately arranged, as regards the terminal polarities, along a circumference of the lighting module 201, for example clockwise as indicated by the circular arrow. Thus, the connection members 203 are symmetrically arranged at all sides of the lighting module 201. This means that it does not matter how the lighting module 201 is oriented in relation to neighboring lighting modules 201. On the other hand, this also means that terminals of different polarities, located on neighboring lighting modules 201, are positioned side by side in opposite to the above-mentioned straightforward solution. Thus, they must not be directly engaged with each other.

Figure 3:
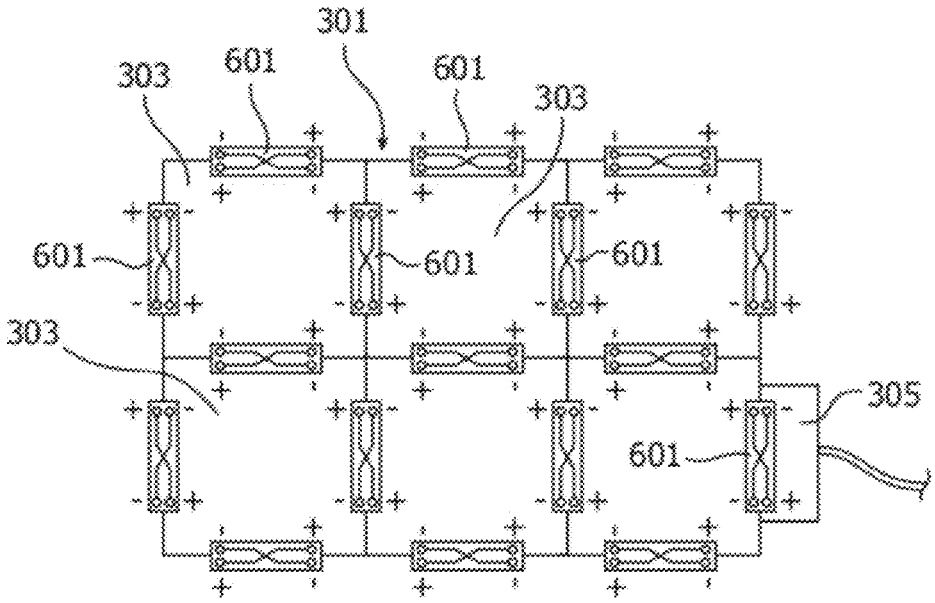
FIG. 3 illustrates the configuration of FIG. 2 with mounted connection members.
Figure 6:
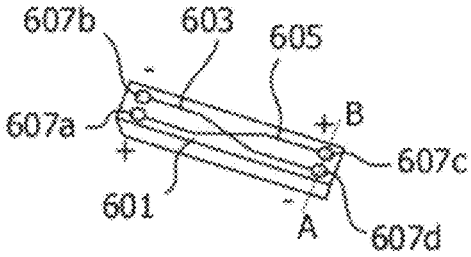
FIG. 6 illustrates the wiring of a bridge member as employed in the embodiments of FIGS. 4 and 5.

However, the lighting system according to this invention further comprises bridge members. The wiring of one embodiment of a bridge member 601 is shown in FIG. 6. In FIG. 3 such bridge members 601 are mounted on every connection member on every lighting module 303 in the arrangement 301. Each bridge member 601 is mountable at two neighboring DC connection members, each associated with a respective lighting module 303. The bridge member 601 forms a bridge providing an electric connection between terminals of equal polarity of the two DC connection members. The bridge member 601 is provided with four-bridge terminals 607*a-d*, which is arranged in the corners of a rectangle and which is diagonally interconnected by means of crossing wires 603, 605. Thereby it is ensured that irrespective of how the bridge member 601 is rotated when mounted on the connection members 203 the respective positive terminals 205 are interconnected and the respective negative terminals 207 are interconnected. Of course the cross-wires 603, 605 are insulated from each other. A DC power source module 305, which is provided with a connection member of the same type as those of the lighting modules 303 is connected to one of the lighting modules 303 by means of a bridge member 601.

Figure 4:
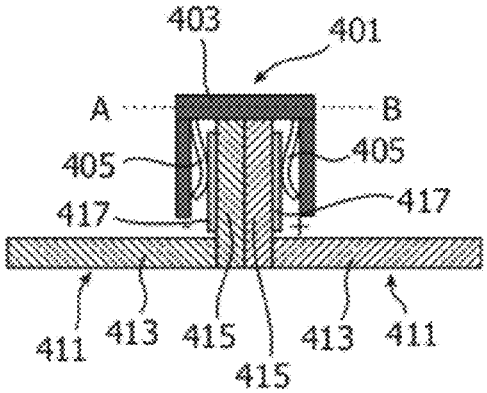
FIGS. 4 and 5 are cross-sectional views of different embodiments of the connection members and bridge members.
Figure 15:
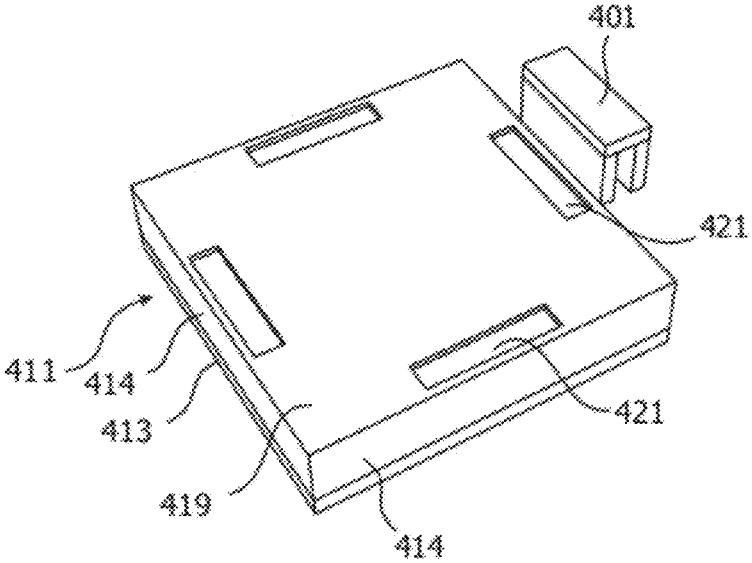
FIG. 15 is a perspective view showing the outer appearance of a lighting module according to this invention.

Referring to FIG. 4, in one embodiment the bridge member 401 comprises a body 403, which is of an insulating material and has a U-shaped cross-section, four metal clamps 405 rectangular arranged in pairs close to the respective ends of the body 403, and the wires 603, 605 mentioned above. The metal clamps 405 correspond to the above-mentioned bridge terminals 607*a-d*. The body 403 consists of a bottom plate 407 and opposite long side wall plates 409 extending perpendicularly to the bottom plate 407 and being joined with the bottom plate 407 at the long sides thereof. Preferably, the side wall plates 409 are integral with the bottom plate 407. The clamps 405 of each pair are arranged opposite to each other at the insides of the long side wall plates 409, that is at the sides facing each other. Each lighting module 411 is basically brick shaped, as shown in FIG. 15. It has a front plate 413, which typically are a diffuser, sidewalls 414 and a rear plate 419. The rear plate is provided with four elongated holes 421, one at each side of the lighting module 411, for receiving the bridge members 401. Each lighting module 411 has a connection member 415 comprising a wall portion 416 of the sidewall 414 and two longitudinally spaced contact elements 417. The contact elements 417 are fastened on said wall portion 416 on an inwardly, i.e. towards the inner area of the lighting module 411, facing side thereof.

When assembling two lighting modules 411, they are pushed or shifted together such that their respective connection members 415 abut on each other. Then, the bridge member 401 is forced down onto the connection members 415 until the bottom plate 407 of the bridge member 401 abuts on upper long side edges of the wall portions 416. Then the metal clamps 405 have made contact with the contact elements 417 of the connection members 415. Thereby electrical connection has been established between the lighting modules 411. Additionally the bridge member 401 mechanically clamps the lighting modules 411 together.

Figure 5:
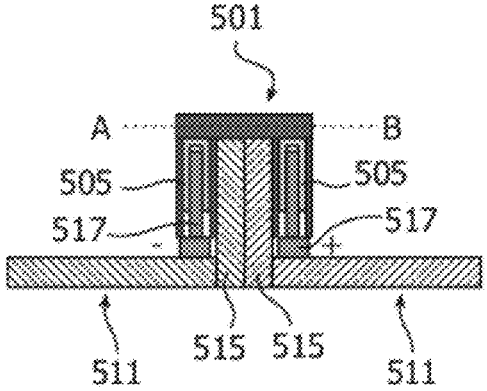

According to an alternative embodiment of the bridge member and connection member, as shown in FIG. 5, the basic shape and structure of the bridge member 501 and the connection member is the same but the terminals are different. Thus, the contact elements of the connection member 515 are constituted by pins and the bridge terminals 505 are constituted by sockets.

Figure 7:
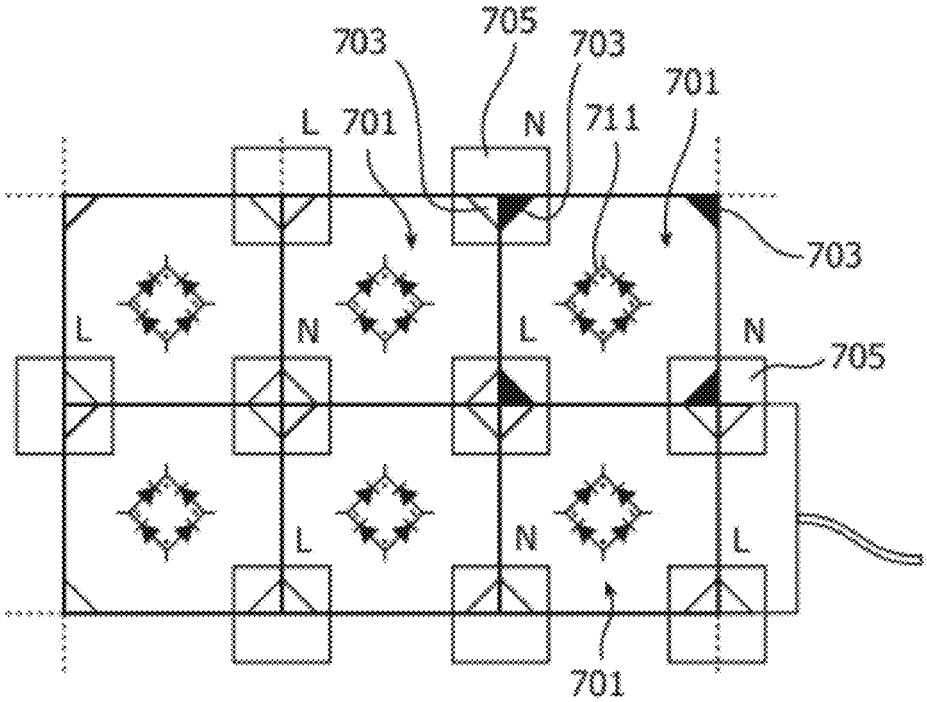
FIGS. 7-10 illustrate configurations of lighting modules according to further embodiments of the lighting system of this invention.
Figure 11:
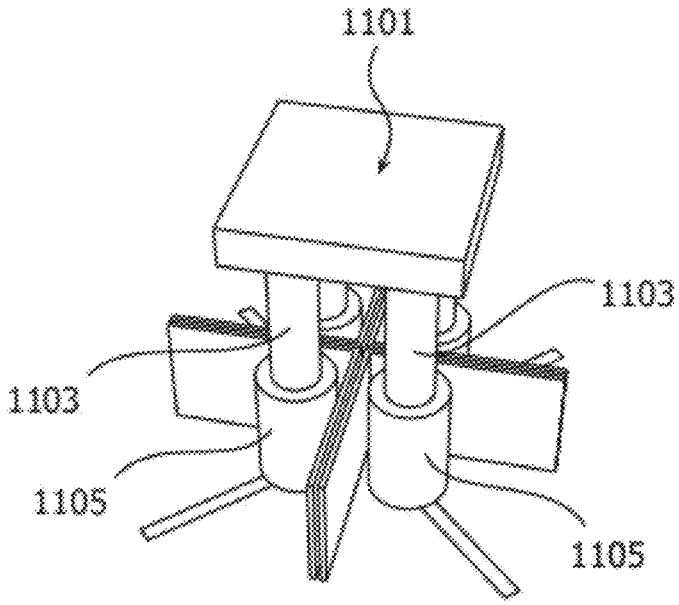
FIG. 11, in a perspective view, schematically shows an embodiment of a bridge member as employed in the embodiments of FIGS. 7, 8 and 10.

According to an advantageous second embodiment of the lighting system, as shown in FIG. 7, a lighting module 701 comprises merely corner connection members 703 and corner bridge members 705, also shown at 1101 in FIG. 11. Each corner connection member 701 consists of a corner connection terminal 703, shown at 1105 in FIG. 11. The corner connection terminals 703, 1105 are alternately interconnected. For example, in the shown embodiment where the lighting modules 701 are squared, the corner connection terminals 703, 1105 are interconnected in pairs diagonally of the lighting module 701. The corner bridge member 1101 has four legs, constituting corner bridge terminals 1103, which are mountable at corner connection terminals 1105. All the corner bridge terminals 1103 are interconnected. Thus, the corner bridge member 705, 1101, at a maximum, interconnects four corner connection terminals, one on each lighting module of four neighboring modules 701, thereby feeding a power of a certain polarity that has been applied to one corner connection terminal 703, 1105 of a lighting module 701 to the other three corner connection terminals. In this embodiment the corner bridge terminals 1103 are positioned at the corners of a square, and they are formed as pins, which fit into the corner connection terminals, which are formed as sockets. In addition to the electrical connection, the corner bridge members 705 provide mechanical connection between the lighting modules 701.

The corner connection terminals 703 of a first polarity are also connected to a first input terminal of a common rectifier bridge 711, and the terminals of a second polarity are connected to a second input terminal of the rectifier bridge 711. In this embodiment, the rectifier bridge 711 is a diode rectifier bridge, of a kind called Graetz rectifier. The rectifier bridge 711 rectifies input AC power equally, irrespective of which corner connection terminals are connected to which polarity, i.e. line or neutral, of the power source. The same is true for a DC power source, where the polarities are plus and minus. It should be noted that the rectifier bridge 711 might be preceded by transformer in order to lower an input AC voltage, if required. On the other hand this alternative is an AC only solution. According to an alternative embodiment of the lighting module 1301 having merely corner connection members, the corner connection members 1303 are formed as twin members. Thus, each corner connection member 1303 has two connection terminals 1305, 1307, which are arranged close to the corner of the lighting module 1301, but at two different sides thereof. In each corner connection member 1303 the terminals 1305, 1307 are interconnected. Further, in this embodiment as well, the corner connection members 1303 are diagonally interconnected in pairs. From one manufacture point of view, the twin members are preferred before the single corner members.

Figure 14:
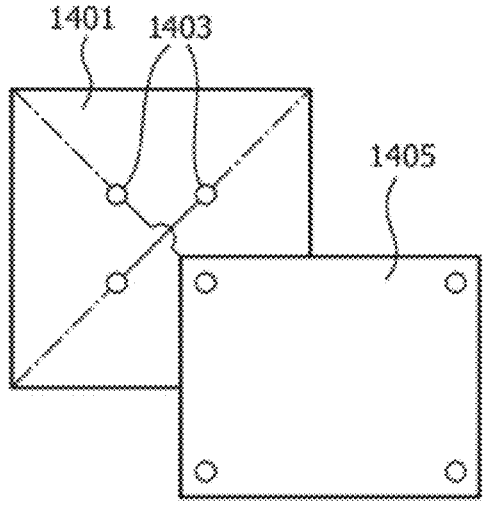

The above-described embodiments of the lighting module having only corner connection members, which are connected in pairs diagonally of the lighting module, the corner connection members can be regarded as one example of diagonally interconnected connection members, and another one is shown in FIG. 14. These diagonally interconnected connection members 1403 are arranged at a considerably longer distance from the corners of the lighting module 1401. They are even closer to the center of the lighting module 1401 than corners thereof. There are advantages with this embodiment, while a disadvantage is the size of the bridge members 1405. Each bridge member 1405 still interconnects four lighting modules 1401. The closer to the center of the lighting module 1401 the connection members 1403 are located, the closer to the size of the lighting module the size of the bridge member 1405 gets. Thus, each connection member 1403 of the lighting module is arranged at a bisector of a respective corner of the lighting module. This definition also includes at least all embodiments of the corner connection members.

Figure 12:
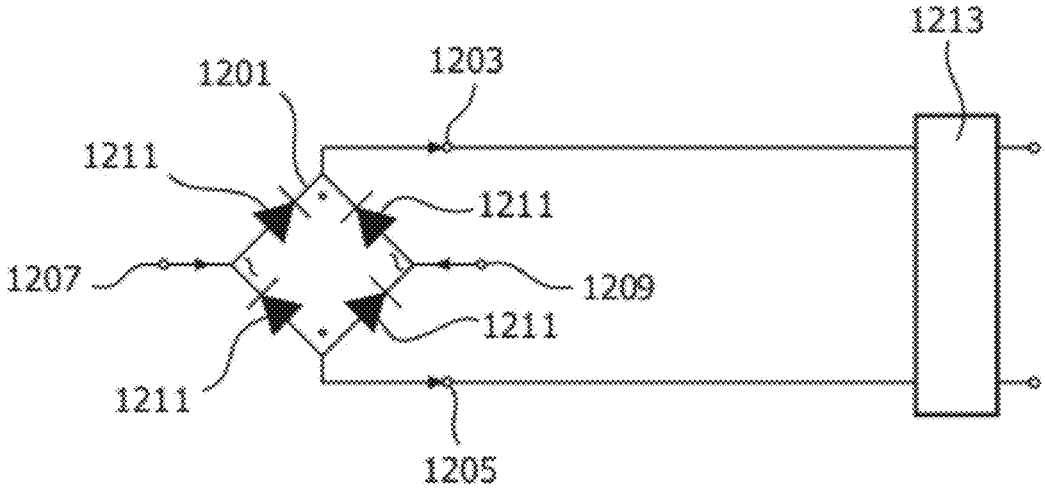
FIG. 12 is a block diagram of a power adaptation circuit employed in embodiments of a lighting module according to this invention.
Figure 13:
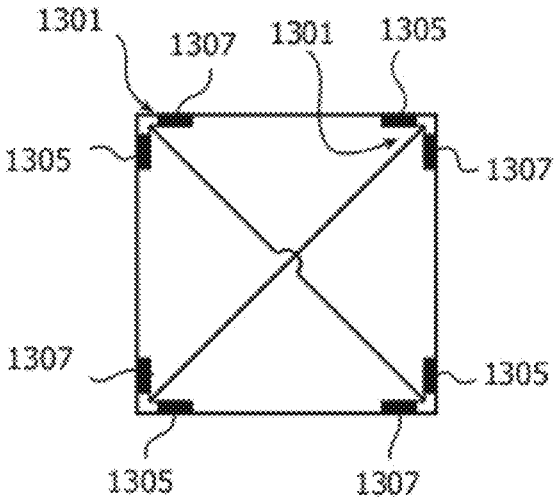
FIGS. 13 and 14 illustrate configurations of lighting modules according to yet further embodiments of the lighting system of this invention.

In FIG. 12 a schematic diagram of the diode bridge 1201 is shown. Seen from the output terminals 1203, 1205 the bridge consists of four diodes arranged in two parallel branches extending between the output terminals 1203, 1205. Each branch has two series connected diodes 1211. Each one of the input terminals 1207, 1209 is connected to a respective branch at a point between the diodes 1211. Considering the fact that a regular diode has a threshold voltage of approximately 0.75V, an input voltage will drop about 1.5V when passing the diode bridge 1201. Consequently, it is an advantage to combine the diode bridge with a DC/DC converter 1213, and use a high voltage AC power source, such as a mains AC voltage.

Figure 8:
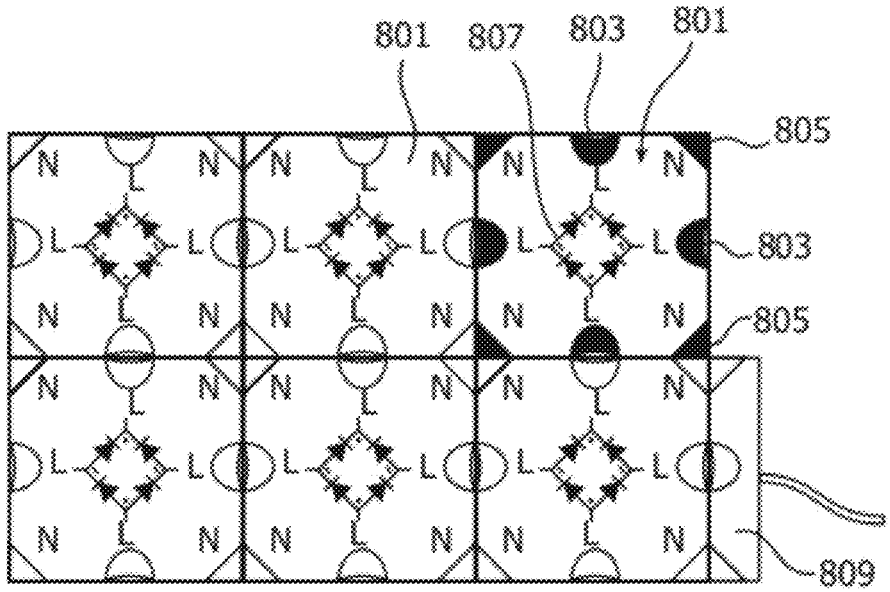

Referring now to FIG. 8, in a third embodiment of the lighting system each lighting module 801 has side as well as corner connection members 803, 805, which are connected to a rectifier bridge 807. The side connection members are interconnected, and the corner connection members are interconnected. Thus, the corner connection members 805 all have the same polarity, and the side connection members have the same polarity. The corner bridge member 1101 described above is mountable on these corner connection members 805 as well. Each side connection member contains a single terminal. An appropriate side bridge member, being half of a side bridge member shown in FIG. 9, to be described below, has two terminals, which are mountable on the side connection terminals 803 of the side connection members 803 of two neighboring lighting modules 801. Also in this embodiment both AC and DC power supply can be used. A power supply contact 809 is connected to the corner and side connection members 805, 803 of one side of one of the lighting modules 801.

Figure 9:
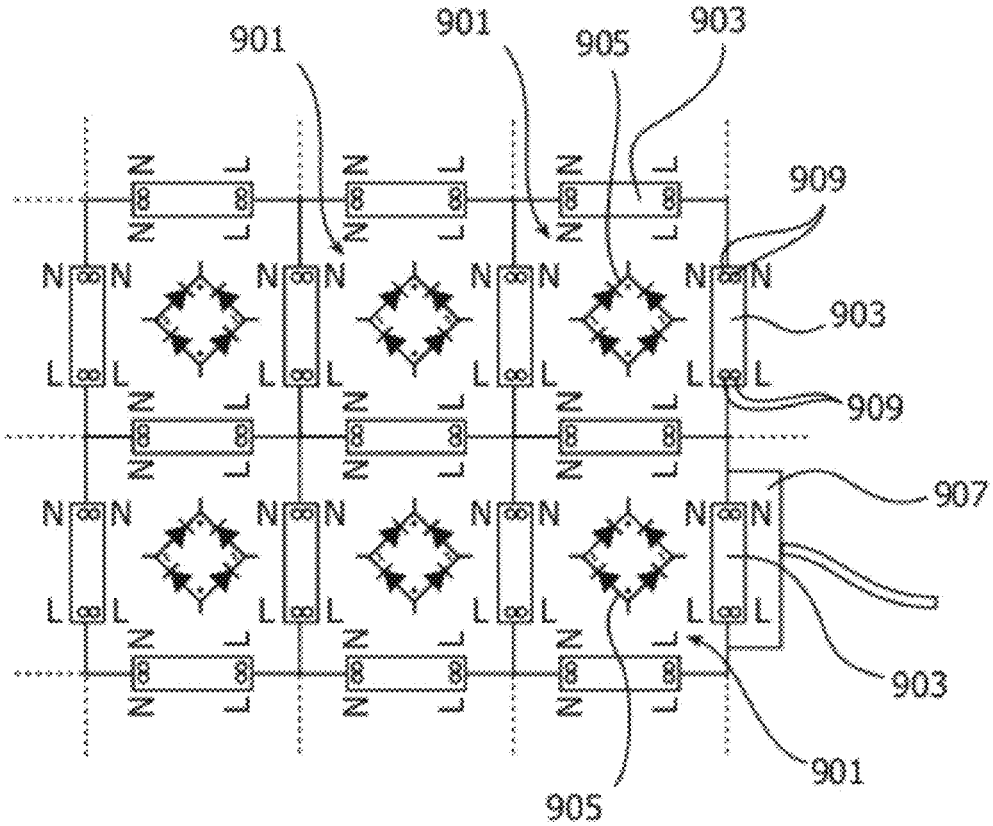

Referring now to FIG. 9, a fourth embodiment having only side connection members is shown. In the figure assembled lighting modules 901, side bridge members 903, rectifier bridges 905 and a power supply contact 907 are shown. Similar to the bridge members 601 of the first embodiment described above, each side bridge member 903 contains four side bridge terminals 909. However, in this embodiment the bridge terminals 909 are interconnected in pairs transversal of the bridge member rather than diagonally. The pairs are spaced along the side of the lighting module 901. Thus, two connection terminals arranged on neighboring lighting modules 901, and facing each other are interconnected by means of the bridge member 903. Alternatively, it is possible to use diagonal interconnections.

Figure 10:
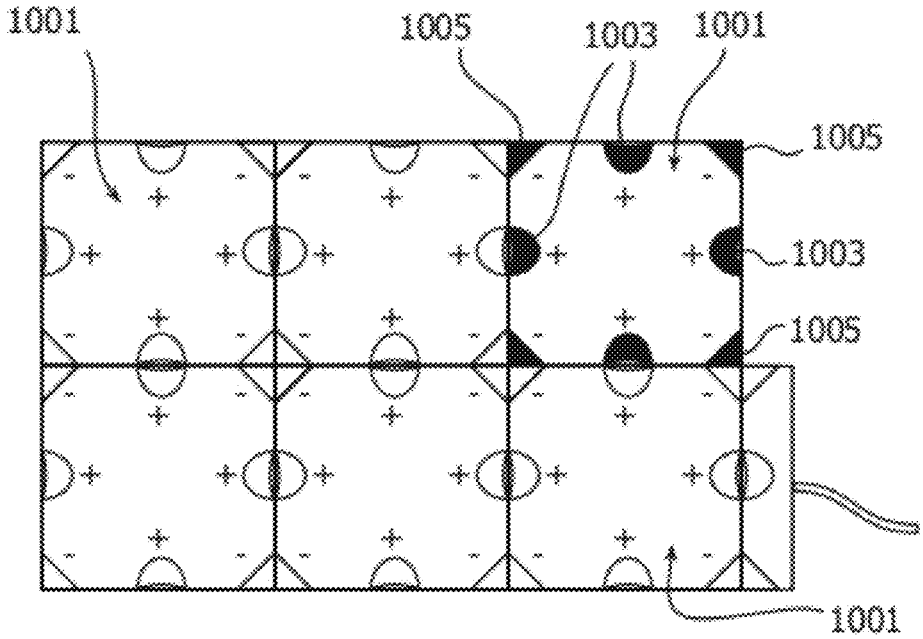

Referring now to FIG. 10 a fifth embodiment of the lighting system comprises lighting modules 1001 having a combination of corner and side connection members 1003, 1005, just like the lighting modules of the third embodiment described above. On the contrary, in this embodiment the lighting modules do not have rectifier bridges. They are meant for DC supply only. All corner connection members have terminals of a first polarity, such as minus, and all side connection members have terminals of a second polarity, such as plus.

Figure 16:
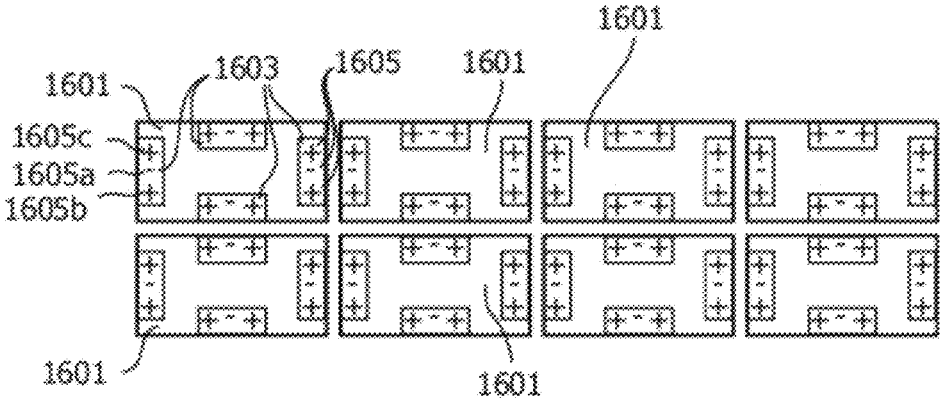
FIG. 16 illustrates a configuration of lighting modules according to a further embodiment of the lighting system of this invention.
Figure 17:
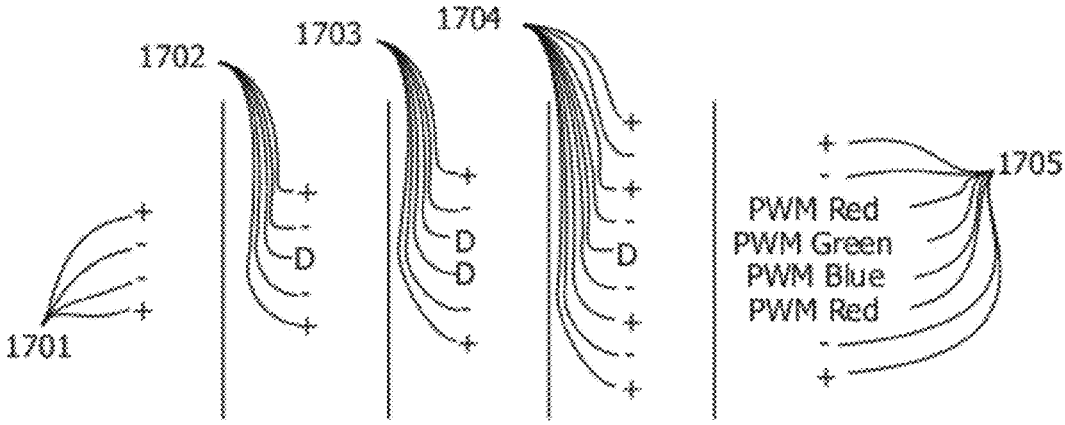
FIG. 17 illustrates connection terminal structures according to different embodiments of lighting modules.

Referring now to FIG. 16 a sixth embodiment of the lighting system comprises lighting modules 1601, which have symmetrical side connection members 1603. The symmetry means that the connection terminals 1605 of each connection member 1603 are arranged symmetrically about, or are mirrored in, a central plane of the connection member 1603. For example, in the shown embodiment, there is a central negative terminal 1605*a*, which is placed in the central plane, and a positive terminal 1605*b*, 1605*c* at each side of the negative terminal 1605*a*. Other examples of terminal combinations are shown in FIG. 17. Thus, in a first example in FIG. 17, from one end to the other end of the connection member there are four consecutive terminals 1701 arranged along a side of a lighting module, consisting of a positive terminal followed by two negative terminals and finished by another positive terminal. In this first example, the central plane is positioned in the middle between the negative terminals 1701. In a second example there are five consecutive terminals 1702, consisting of a positive terminal, a negative terminal, a data terminal, a negative terminal, and a positive terminal. In a third example, there are six consecutive terminals 1703, consisting of a positive terminal, a negative terminal, two data terminals, a negative terminal, and a positive terminal. In another example, there are nine terminals 1704 including power as well as data terminals. The terminals may be of further types as well, such as PWM signals to light elements of the lighting module, as shown at 1705 in a further example in FIG. 17.

When the connection member 1603 is symmetrical at least for one signal there are more than one connection terminal available. A drawback of such multiple connection terminals is that they increase the size of the connection member 1603. However, an advantage thereof is that, since the current can be spread over multiple terminals, the current rating of the connection member 1603 can be lowered in comparison with a non-symmetrical connection member having a minimum number of connection terminals.

Further, the symmetrical connection members in a sense simplify the bridge members. No cross-connection between terminals is necessary, but the bridge member has simple parallel wires. Each wire extends straight between opposite bridge terminals, which interconnect two opposite connection terminals of two connection members 1603 belonging to two adjacent lighting modules 1601.

Figure 18:
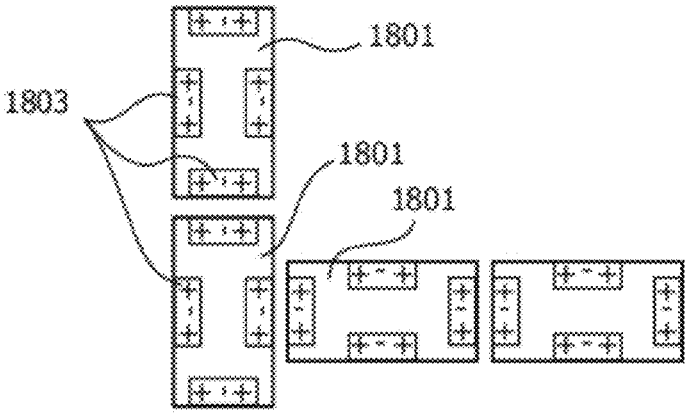
FIG. 18 illustrates optional interconnection possibilities of the lighting modules in FIG. 16.

The electrical connection of adjacent lighting modules according to the present invention provides for flexibility in rotation of the lighting modules that allows for non-square shapes of the lighting modules. For example, the lighting modules can be rectangular as shown in FIG. 18. For example, if the rectangular lighting modules 1801 have side connection members 1803 a short side of one lighting module 1801 is connectable to the long side of another lighting module 1801. However various shapes are possible, for instance shapes usable for forming curved or Y-shaped lighting systems.

Figure 19:
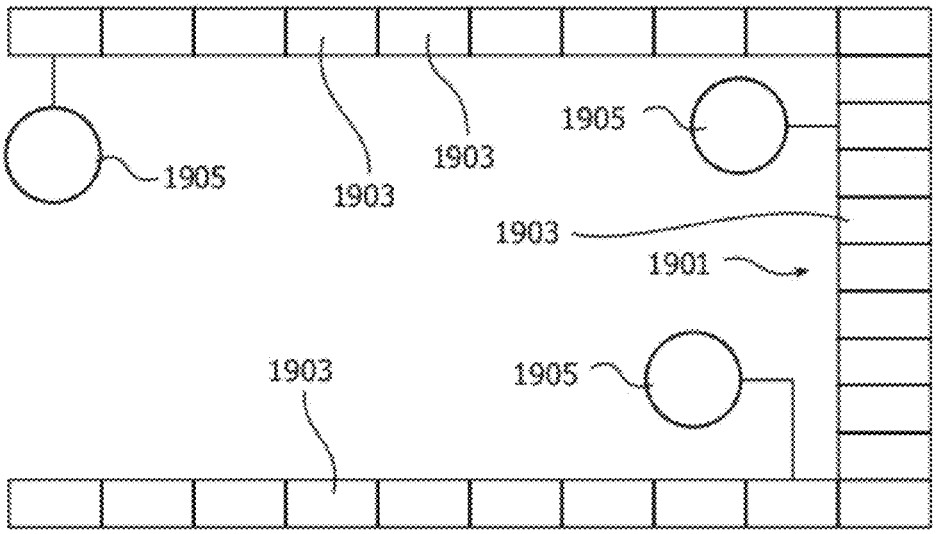
FIGS. 19 and 20 illustrate different arrangements of power supplies of the lighting system.
Figure 20:
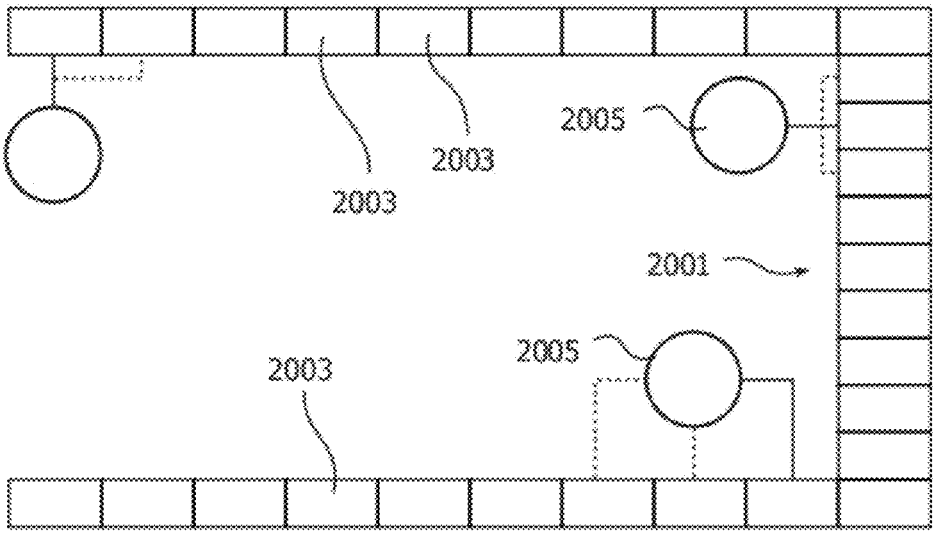

The lighting system consisting of multiple interconnected lighting modules has an advantage of being powerable at a single power connection at one of the lighting modules, since the power is then forwarded via the connection members from module to module throughout the system. However, a lighting module is only capable of conducting a limited current. Since the module connected to the external power supply has to carry the current of all modules the maximum number of modules in the system becomes limited as well. A solution to that problem is to use multiple external power supplies, which are connectable in parallel and which are distributed over the lighting system, an example of which is shown in FIG. 19. The exemplifying lighting system 1901 has 30 lighting modules 1903. Further, each power supply 1905 is an AC/DC converter having a limited power. Then there is no need for an internal converter of each module 1903. Assume that each power supply 1905 is capable of powering up to 10 modules and that each module is capable of conducting a maximum current, which is sufficient for supplying 10 modules. Then three power supplies 1905 are needed, connected to a respective one of the modules 1903 and well distributed over the system 1901. If all three power supplies would be connected to the same module 1903 an over current would occur in that module. In order to obtain an amount of flexibility with respect to the placement of the power supplies, there is introduced a large enough tolerance on the current conduction capability of each module. The flexibility thus obtained is illustrated in FIG. 20. It should be noted that the current throughout the lighting system 2001 would redistribute itself if the power supplies 2005 were not equally distributed among the lighting modules 2003.

Above, embodiments of the lighting system according to the present invention have been described. These should be seen as merely non-limiting examples. As understood by a skilled person, many modifications and alternative embodiments are possible within the scope of the invention.

Thus, as explained by means of the embodiments above, an easy to use solution for how to interconnect lighting modules electrically, but also mechanically, while providing full rotational freedom when assembling the lighting modules is obtained. The lighting modules are typically provided with connection members at their sides or their corners or both. Bridging members are provided. They are mounted at the connection members for interconnecting terminals thereof. Preferably, in addition, the bridging members act as mechanical clamps.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A structure comprising:

a lighting module, the lighting module comprising:

at least two connection members, each connection member comprising a positive terminal and a negative terminal, wherein the positive terminals of the connection members in the module are interconnected and the negative terminals of the connection members in the module are interconnected;

wherein the positive and negative terminals are alternately arranged proximate edges of the lighting module;

a second lighting module, the second lighting module comprising:

at least two connection members, each connection member comprising a positive terminal and a negative terminal, wherein the positive terminals of the connection members in the module are interconnected and the negative terminals of the connection members in the module are interconnected;

wherein the positive and negative terminals are alternately arranged proximate an edge of the lighting module; and a bridge member comprising:

a first interconnect that electrically connects a positive terminal on the first lighting module to a positive terminal on the second lighting module; and a second interconnect that electrically connects a negative terminal on the first lighting module to a negative terminal on the second lighting module.

2. The structure of claim 1 wherein the lighting module is rotationally symmetrical.

3. The structure of claim 1 wherein each connection member is disposed along a substantially straight edge of the lighting module.

4. The structure of claim 1 wherein the lighting module is polygonal.

5. The structure of claim 1 wherein the bridge member further comprises four terminals disposed at corners of a rectangle, wherein the first interconnect diagonally interconnects two terminals and the second interconnect diagonally interconnects two terminals.

6. The structure of claim 1 wherein the first and second interconnects comprise crossing wires that are electrically insulated from each other.

7. The structure of claim 1 wherein the bridge member mechanically connects the first lighting module to the second lighting module.

8. The structure of claim 1 wherein:

the positive and negative terminals on each said connection member comprise pins; and the bridge member comprises sockets compatible with the pins.

9. A method for construction of a lighting system comprising:

connecting at least two lighting modules together, each lighting module comprising a plurality of terminals of first polarity and a plurality of terminals of second polarity, wherein the terminals of first polarity alternate with the terminals of second plurality, wherein each lighting module is rotationally symmetrical with respect to the arrangement of the terminals of first and second polarity, and wherein the two lighting modules are electrically connected by at least one bridge member; and powering the at least two lighting modules by a single power connection to one of the lighting modules, wherein power is forwarded to the other lighting module via the terminals of first and second polarity and by the bridge member;

each lighting module is polygonal;

the terminals of first polarity are disposed on the corners of each polygonal lighting module; and the terminals of second polarity are disposed on the sides of each polygonal lighting module.

10. The method of claim 9 wherein each lighting module comprises a plurality of connection members, wherein each connection member includes a terminal of first polarity and a terminal of second polarity, wherein the connection members are disposed along edges of each lighting module.

11. The method of claim 9 wherein the terminals of first and second polarity are disposed on the corners of each lighting module.

12. The method of claim 9 wherein the lighting modules are square.

13. The method of claim 9 wherein powering the at least two lighting modules comprises connecting at least one lighting module to an AC power source.

14. The method of claim 9 wherein powering the at least two lighting modules comprises connecting at least one lighting module to a DC power source.

* * * * *